US006793696B2

(12) United States Patent
Krull et al.

(10) Patent No.: US 6,793,696 B2
(45) Date of Patent: Sep. 21, 2004

(54) ENHANCED LUBRICITY FUEL OIL COMPOSITIONS COMPRISING SALTS OF FATTY ACIDS WITH SHORT CHAIN OIL-SOLUBLE AMINES

(75) Inventors: Matthias Krull, Oberhausen (DE); Markus Kupetz, Dinslaken (DE)

(73) Assignee: Clariant GmbH, Frankfurt (DE)

( * ) Notice: Subject to any disclaimer, the term of this patent is extended or adjusted under 35 U.S.C. 154(b) by 88 days.

(21) Appl. No.: 10/035,522

(22) Filed: Nov. 9, 2001

(65) Prior Publication Data

US 2002/0095858 A1 Jul. 25, 2002

(30) Foreign Application Priority Data

Nov. 24, 2000 (DE) ..... 100 58 356

(51) Int. Cl.[7] ..... C10L 1/22
(52) U.S. Cl. ..... 44/408; 44/418
(58) Field of Search ..... 44/418, 408

(56) References Cited

U.S. PATENT DOCUMENTS

| | | | | |
|---|---|---|---|---|
| 4,211,534 A | | 7/1980 | Feldman | |
| 4,670,516 A | | 6/1987 | Sackmann et al. | |
| 4,732,576 A | * | 3/1988 | Friedrich et al. | 44/301 |
| 4,882,034 A | * | 11/1989 | Tack et al. | |
| 4,985,048 A | | 1/1991 | Wirtz et al. | |
| 5,186,720 A | | 2/1993 | Feustel et al. | |
| 5,391,632 A | | 2/1995 | Krull et al. | |
| 5,755,834 A | * | 5/1998 | Chandler | 44/386 |
| 6,071,993 A | * | 6/2000 | Wenderoth et al. | 44/346 |
| 6,511,520 B1 | | 1/2003 | Eber et al. | 44/388 |
| 2002/0014034 A1 | | 2/2002 | Bernasconi et al. | 44/329 |

FOREIGN PATENT DOCUMENTS

| | | |
|---|---|---|
| DE | 1 645 886 | 6/1971 |
| DE | 28 52 541 | 6/1979 |
| EP | 1 153 176 | 8/1985 |
| EP | 0 320 766 | 6/1989 |
| EP | 0 154 177 | 11/1989 |
| EP | 0 413 279 | 12/1992 |
| EP | 0 606 055 | 7/1994 |
| EP | 0798 364 | 10/1997 |
| EP | 0 926 221 | 6/1999 |
| WO | 95/33805 | 12/1995 |
| WO | 96/18706 | 6/1996 |
| WO | 96/23855 | 8/1996 |
| WO | WO 98/04656 | 2/1998 |
| WO | WO 99/33938 | 7/1999 |
| WO | 99/36489 | 7/1999 |
| WO | 00/15739 | 3/2000 |

OTHER PUBLICATIONS

H.A. Spikes, "The Lubricity of Diesel Fuels", Wear, 111, (1986), 217–235.
N.A. Plate' and V.P. Shibaev, "Comb–like Polymers, Structure and Properties", J. Polymer Sci.: Macromolecular Reviews, vol. 8, 117–253 (1974).
German office action for application No. 10058356, mail date Feb. 14, 2001.
English abstract for DE 28 52 541, Jun. 7, 1979.
Machine translation to English of the Introduction of DE 1 645 886.

* cited by examiner

*Primary Examiner*—Cephia D. Toomer
(74) *Attorney, Agent, or Firm*—Richard P. Silverman

(57) ABSTRACT

Disclosed is a fuel oil composition comprising a middle distillate having a sulfur content of up to 0.05% by weight and reaction products of
A) mono- or dicarboxylic acids of 6 to 50 carbon atoms and
B) primary, secondary or tertiary amines of the formula $$NR^1R^2R^3$$

where $R^1$ is branched alkyl of 3 to 18 carbon atoms and $R^2$ and $R^3$ are independently hydrogen, $R^1$ or alkyl of 1–12 carbon atoms.

16 Claims, No Drawings

ENHANCED LUBRICITY FUEL OIL COMPOSITIONS COMPRISING SALTS OF FATTY ACIDS WITH SHORT CHAIN OIL-SOLUBLE AMINES

BACKGROUND OF THE INVENTION

The present invention relates to reaction products of fatty acids with short-chain oil-soluble amines that possess good cold stability and to their use for enhancing the lubricity of middle distillate fuel oil compositions.

1. Field of the Invention

Mineral oils and mineral oil distillates used as fuel oils generally contain 0.5% by weight or more of sulfur which burns to form sulfur dioxide. To lessen the resultant environmental pollution, the sulfur content of fuel oils is being progressively lowered. The EN 590 standard for diesel fuels currently prescribes a maximum sulfur content of 350 ppm for Germany. In Scandinavia, fuel oils already in use contain as little as 50 ppm of sulfur, exceptionally even less than 10 ppm. These fuel oils are generally produced by hydrorefining the fractions obtained from petroleum by distillation. But the desulfurizing step also removes substances that confer natural lubricity on fuel oils. These substances include polyaromatic and polar compounds.

It has now been determined that the friction and wear reducing properties of fuel oils deteriorate with increasing desulfurization. These properties are frequently so poor that materials lubricated by the motor fuel, for example the distributor injection pumps of diesel engines, are quickly prone to showing signs of pitting. This problem is made more acute by the maximum value for the 95% distillation point as per EN 590 having been set to not more than 360° C. since 2000 and the further reduction in the 95% distillation point to below 350° C. and in some instances to below 330° C. that has in the meantime taken place in Scandinavia.

2. Description of the Related Art

There are prior art proposals for solving this problem with lubricity additives or enhancers.

WO-A-99/36489 discloses the use of mixtures of monomeric and polymeric fatty acids for improving the lubricity of low sulfur middle distillates.

EP-A-0 798 364 discloses salts and amides of mono- to tetracarboxylic acids of 2 to 50 carbon atoms and aliphatic mono-/polyamines of 2 to 50 carbon atoms and 1 to 10 carbon atoms as lubricity enhancers for low sulfur diesel fuel. Preferred amines have 8 to 20 carbon atoms, for example cocoamine, tallowamine and oleylamine.

WO-A-95/33805 discloses the use of cold flow improvers to enhance the lubricity of low sulfur middle distillates. Substances mentioned as suitable include polar nitrogenous compounds containing an $NR^{13}$ group, where $R^{13}$ is hydrocarbyl of 8 to 40 carbon atoms and can be present in the form of a cation.

WO-A-96/18706 discloses by analogy with WO-A-95/33805 the use of the nitrogenous compounds mentioned therein in combination with lubricity additives.

WO-A-96/23855 discloses by analogy with WO-A-95/33805 the use of the nitrogenous compounds mentioned therein in combination with detergent additives.

EP-A-0 926 221 discloses salts of $C_6$–$C_{20}$-alkylphenols with primary or secondary aliphatic $C_6$–$C_{50}$-monoamines for improving the lubricity of low sulfur diesel fuel.

WO-A-00/15739 discloses a low sulfur diesel fuel composition possessing improved lubricity, containing at least one dicarboxylic acid, at least one amine having a straight-chain hydrocarbon radical and optionally a monocarboxylic acid. The substances can be present as physical mixtures or else as salts, amides and/or imides. The additized oils exhibit improved lubricity, stability in storage and corrosion control.

The fatty acids, fatty acid ammonium salts and fatty acid amides used in the prior art have the disadvantage of solidifying on storage at low temperatures, i.e., frequently at room temperature, usually at temperatures of 0° C., at the latest at −5° C., or that crystalline fractions separate and cause handling problems. This problem is only partly solvable by diluting with organic solvents, since fractions will crystallize out even from these solutions or the solution will gel and solidify. For use as lubricity additives they consequently have to be greatly diluted or kept in heated storage vessels and added via heated pipework.

It is an object of the present invention to provide lubricity additives that enhance the lubricity of middle distillates, but remain homogeneous, clear and especially flowable at low temperatures and do not adversely affect the cold flow properties of middle distillates.

SUMMARY OF THE INVENTION

It has been found that reaction products of fatty acids with branched, short-chain, oil-soluble imines remain flowable and clear for a prolonged period even at substantially lower temperatures, in some instances to below −20° C., in special cases to below −50° C., and enhance the lubricity of middle distillates more efficiently than pure fatty acids of the prior art.

DETAILED DESCRIPTION OF THE INVENTION

This invention accordingly provides a fuel oil composition comprising a middle distillate having a sulfur content of up to 0.05% by weight and reaction products of mono- or dicarboxylic acids of 6 to 50 carbon atoms and primary, secondary or tertiary amines of the formula $$NR^1R^2R^3$$

where $R^1$ is branched alkyl of 3 to 18 carbon atoms and $R^2$ and $R^3$ are independently hydrogen, $R^1$ or alkyl of 1–12 carbon atoms.

The present invention further provides for the use of the reaction products mentioned for improving the lubricating properties of low sulfur middle distillates.

The present invention yet further provides an additive for enhancing the lubricity of middle distillates having a sulfur content of up to 0.05% by weight, comprising reaction products of mono- or dicarboxylic acids of 6 to 50 carbon atoms and primary, secondary or tertiary amines of the formula $$NR^1R^2R^3$$

where $R^1$ is branched alkyl of 3 to 18 carbon atoms and $R^2$ and $R^3$ are independently hydrogen, $R^1$ or alkyl of 1–12 carbon atoms.

Preferred fatty acids (ingredient A) are fatty acids of 8 to 40 carbon atoms, especially 12 to 22 carbon atoms. They may contain one or more double bonds and be of natural or synthetic origin. Ingredient A preferably comprises fatty acids that contain at least one double bond or fatty acid mixtures in which at least 50% by weight, especially at least 75%, specifically at least 90%, of the ingredients contain one or more double bonds. In polyunsaturated carboxylic acids, the double bonds may be isolated or else conjugated. The fraction of saturated fatty acids is preferably below 20%, especially below 10%, specifically below 5%. The alkyl radicals of the fatty acids consist essentially of carbon and hydrogen. However, they may carry further substituents such as for example hydroxyl, hydrogen, amino or nitro groups, provided these do not impair the predominant hydrocarbon character. Useful fatty acids include for example lauric acid, tridecanoic acid, myristic acid, pentadecanoic acid, palmitic acid, margaric acid, stearic acid, isostearic acid, arachidic acid, behenic acid, oleic acid, erucic acid, palmitoleic acid, myristoleic acid, linoleic acid, linolenic acid, elaeosteric acid and arachidonic acid, ricinoleic acid and also fatty acid mixtures obtained from natural fats and oils, for example coconut oil fatty acid, peanut oil fatty acid, fish oil fatty acid, linseed oil fatty acid, palm oil fatty acid, rapeseed oil fatty acid, ricinenic oil fatty acid, castor oil fatty acid, colza oil fatty acid, soybean fatty acid, sunflower oil fatty acid, and tall oil fatty acid. Preferred fatty acid (mixtures) have iodine numbers of at least 40 gl/100 g, preferably at least 80 gl/100 g, especially at least 125 gl/100 g.

It is likewise possible to use dicarboxylic acids, such as dimer fatty acids and alkyl- and alkenylsuccinic acids having $C_8$–$C_{50}$-alk(en)yl radicals, preferably $C_8$–$C_{40}$-, especially $C_{12}$–$C_{22}$-alkyl radicals. The alkyl radicals may be linear or branched (oligomerized alkenes such as oligopropylene, polyisobutylene).

The fatty acids may further contain 1–40%, specifically 1–25%, of resin acids.

Useful amines (ingredient B) are primary, secondary and tertiary amines carrying at least one branched $C_3$–$C_{18}$-alkyl radical, preferably $C_4$–$C_{12}$-alkyl radical, especially $C_4$–$C_8$-alkyl radical. By branching is meant herein not only a carbon chain branching (e.g., isoalkyl radicals and tert-alkyl radicals) but also the bonding of the amino group to a secondary or tertiary carbon atom. In a preferred embodiment, the amines are secondary and tertiary amines carrying at least two branched $C_3$–$C_{18}$-alkyl radicals, preferably $C_4$–$C_{12}$-alkyl radicals, especially $C_4$–$C_8$-alkyl radicals. The amines preferably contain at least 4, especially at least 8, specifically at least 10, carbon atoms. The branching site of the alkyl radical is preferably a tertiary carbon atom. The branching site contains the bond to the nitrogen in a preferred embodiment. Preferred branched alkyl radicals are isopropyl, isobutyl, tert-butyl, 3-methylbutyl, amyl, 2-ethylhexyl and also the various isomers of isononyl. Also suitable are nonterminally substituted alkyl radicals such as for example 2-aminobutane, 2-aminopentane, 3-aminopentane, 2-aminohexane, 3-aminohexane, 2-aminoheptane, 2-amino-6-methylheptane and 2-amino-5-methylhexane.

In a further embodiment, $R^2$ and $R^3$ are each preferably hydrogen or lower alkyl of 1–4 carbon atoms such as methyl, ethyl, propyl and butyl.

Examples of suitable amines are isopropylamine, isobutylamine, 2-aminobutane, 3-methylbutylamine, 2-amylamine, 3-amylamine, tert-amylamine, 2-ethylhexylamine, isononylamine, di-sec-butylamine, di-2-amylamine, di-3-amylamine, di-tert-amylamine, di(2-ethylhexyl)amine, diisononylamine and also mixtures of plural amines.

The reaction of carboxylic acid and amine is preferably effected by mixing the two components at low temperatures to form the ammonium salt. The reaction products may be heated to eliminate water and convert them into amides when the amines used carry two or fewer alkyl radicals or into imides when the amines carry only one alkyl radical.

The reaction products of the invention are prepared using preferably between 0.1 and 1.2, preferably between 0.2 and 1.0, mol, especially between 0.9 and 1.0 mol, of amine per mole of acid group. Particular preference is given to fatty acid salts. In a further preferred embodiment, the fatty acids are partly neutralized or partly amidated, i.e., mixtures of fatty acids and their salts and/or amides. Higher than equimolar amine quantities can be used, but do not provide advantages.

The reaction products of the invention are added to oils in amounts of 0.001 to 0.5% by weight, preferably 0.001 to 0.1% by weight. For this they may be used as such or else dissolved in solvents, for example aliphatic and/or aromatic hydrocarbons or hydrocarbon mixtures such as for example toluene, xylene, ethylbenzene, decane, pentadecane, gasoline fractions, kerosene or commercial solvent mixtures such as Solvent Naphtha, ®Shellsol AB, ®Solvesso 150, ®Solvesso 200, ®Exxsol, ®Isopar and ®Shellsol D grades. Preferably the additives of the invention contain 1–80%, specifically 10–70%, especially 25–60%, of solvent. The additives, which can even be used without problems at low temperatures of for example −40° C. or below, enhance the lubricity of additized oils and their corrosion control properties.

To prepare additive packets for specific problem solvers, the reaction products of the invention can also be used together with one or more oil-soluble coadditives which would even on their own improve the cold flow properties and/or lubricity of crude oils, lubricating oils or fuel oils. Examples of such coadditives are vinyl acetate copolymers or terpolymers of ethylene, polar compounds having a paraffin-dispersing effect (paraffin dispersants), comb polymers, alkylphenol-aldehyde resins and also oil soluble amphiphiles.

It is advantageous to use mixtures of the reaction products of the invention with copolymers containing 10 to 40% by weight of vinyl acetate and 60 to 90% by weight of ethylene. In a further execution of the invention, the reaction products of the invention are used in mixture with ethylene-vinyl acetate-vinyl neononanoate terpolymers or ethylene-vinyl acetate-vinyl neodecanoate terpolymers for improving the flowability of mineral oils or mineral oil distillates. The terpolymers of vinyl neononanoate or of vinyl neodecanoate contain 10 to 35% by weight of vinyl acetate and 1 to 25% by weight of the respective neo compound as well as ethylene. Further preferred copolymers, as well as ethylene and 10 to 35% by weight of vinyl esters, contain 0.5 to 20% by weight of olefin such as diisobutylene, 4-methylpentene or norbornene. The mixing ratio of the reaction products of the invention with the above-described ethylene-vinyl acetate copolymers or the terpolymers of ethylene, vinyl acetate and the vinyl esters of neononanoic or neodecanoic acid is (in parts by weight) 20:1 to 1:20, preferably 10:1 to 1:10.

For use as flow improver and/or lubricity additive, the reaction products of the invention may further be used together with paraffin dispersants. Paraffin dispersants reduce the size of paraffin crystals and ensure that paraffin particles do not settle out but remain colloidally dispersed with a substantially reduced sedimentation tendency. They also enhance the lubricity of the additives according to the invention. Useful paraffin dispersants include oil-soluble polar compounds having ionic or polar groups, for example amine salts and/or amides, which are obtained by reaction of aliphatic or aromatic amines, preferably long chain aliphatic amines, with aliphatic or aromatic mono-, di-, tri- or tetracarboxylic acids or anhydrides thereof (cf. U.S. Pat. No.

4,211,534). Paraffin dispersants further include copolymers of maleic anhydride and α,β-unsaturated compounds which may be reacted with primary monoalkylamines and/or aliphatic alcohols (cf. EP 0 154 177), the reaction products of alkenylspirobislactones with amines (cf. EP 0 413 279 B1) and, according to EP 0 606 055 A2, reaction products of terpolymers based on α,β-unsaturated dicarboxylic anhydrides, α,β-unsaturated compounds and polyoxyalkylene ethers of lower unsaturated alcohols. Useful paraffin dispersants yet further include alkylphenol-aldehyde resins.

The reaction products of the invention may be used together with alkylphenol-formaldehyde resins. In a preferred embodiment of the invention, these alkylphenol-formaldehyde resins have the formula

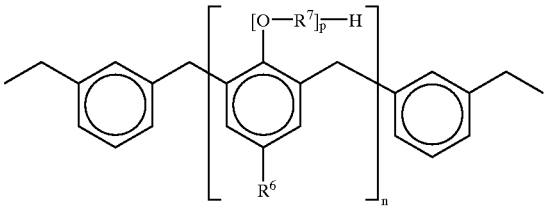

where $R^6$ is $C_4$–$C_{50}$-alkyl or -alkenyl, $R^7$ is ethoxy and/or propoxy, n is from 5 to 100 and p is from 0 to 50.

Finally, in a further embodiment of the invention, the reaction products of the invention are used together with comb polymers. Comb polymers are polymers in which hydrocarbon radicals containing at least 8, especially at least 10, carbon atoms are attached to a polymer backbone. Comb polymers are preferably homopolymers whose alkyl side chains contain at least 8, especially at least 10, carbon atoms. In the case of copolymers, at least 20%, preferably at least 30%, of the monomers have side chains (cf. Comb-like Polymers-Structure and Properties; N. A. Platé and V. P. Shibaev, J. Polym. Sci. Macromolecular Revs. 1974, 8, 117 ff). Examples of suitable comb polymers are for example fumarate/vinyl acetate copolymers (cf. EP 0 153 176 A1), copolymers of a $C_6$–$C_{24}$-α-olefin and an N—$C_6$–$C_{22}$-alkyl maleimide (cf. EP 0 320 766), also esterified olefin-maleic anhydride copolymers, polymers and copolymers of α-olefins and esterified copolymers of styrene and maleic anhydride.

Comb polymers may be described for example by the formula

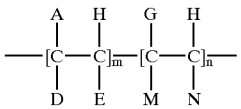

where

A is R', COOR', OCOR', R"—COOR' or OR';

D is H, $CH_3$, A or R;

E is H or A;

G is H, R", R"—COOR', an aryl radical or a heterocyclic radical;

M is H, COOR", OCOR", OR" or COOH;

N is H, R", COOR", OCOR, COOH or an aryl radical;

R' is a hydrocarbon chain of 8–150 carbon atoms;

R" is a hydrocarbon chain of 1–10 carbon atoms;

m is between 0.4 and 1.0; and n is between 0 and 0.6.

The mixing ratio (in parts by weight) of the reaction products of the invention with paraffin dispersant, resins or comb polymers is in each case in the range from 1:10 to 20:1, preferably in the range from 1:1 to 10:1.

The reaction products of the invention are capable of improving the lubricating properties of animal, vegetable, mineral or synthetic fuel oils at very low dosage rates. In addition, they also improve the corrosion control properties of the additized oils. At the same time, the emulsified properties of the additized oils are less impaired than would be the case with lubricating additives of the prior art. The reaction products of the invention are particularly useful in middle distillates. Middle distillates are in particular mineral oils that are obtained by distillation of crude oil and boiled in the range from 120 to 450° C., for example kerosene, jet fuel, diesel and heating oil. The oils may also contain alcohols such as methanol and/or ethanol or consist thereof. The reaction products of the invention are preferably used in middle distillates having a sulfur content of 0.05% by weight or less, particularly preferably less than 350 ppm, especially less than 200 ppm, specifically less than 50 ppm. These are generally middle distillates which have been subjected to hydrorefining and which therefore contain only small fractions of polyaromatic and polar compounds that confer a natural lubricity on them. The reaction products of the invention are further preferably used in middle distillates that have 95% distillation points below 370° C., especially 350° C., specifically below 330° C. They may also be used as components in lubricating oils.

The reaction products may be used alone or else together with other additives, for example with pour point depressants or dewaxing aids, with corrosion inhibitors, antioxidants, sludge inhibitors, dehazers and cloud point depressants.

The enhanced cold stability and the effectiveness of the reaction products of the invention as lubricity additives is more particularly described by the examples which follow.

EXAMPLES

The following additives were prepared:

TABLE 1

Additives (V = comparative)

| Additive | |
|---|---|
| A | Oleic acid neutralized with di(2-ethylhexyl)amine |
| B | Tall oil fatty acid neutralized with di(2-ethylhexyl)amine |
| C | Tall oil fatty acid partially neutralized with 0.33 mol of di(2-ethylhexyl)amine |
| D | Tall oil fatty acid neutralized with 0.1 mol of di(2-ethylhexyl)amine |
| E | Tall oil fatty acid neutralized with 2-aminobutane |
| F | Tall oil fatty acid neutralized with 2-ethylhexylamine |
| G | Tall oil fatty acid neutralized with diamylamine |
| H | Tall oil fatty acid neutralized with di(sec-butylamine) |
| I | Tall oil fatty acid neutralized with N,N-dimethylbutylamine |
| K (V) | Oleic acid neutralized with tri-n-butylamine |
| L (V) | Oleic acid neutralized with oleylamine |

TABLE 2

Additives' own pour points

| Example | Additive | Pour point |
|---|---|---|
| 1 | A | <−40° C. |
| 2 | B | <−40° C. |
| 3 | C | <−40° C. |
| 4 | D | −21° C. |

TABLE 2-continued

| Additives' own pour points | | |
|---|---|---|
| Example | Additive | Pour point |
| 5 | E | <−40° C. |
| 6 | F | <−40° C. |
| 7 | G | <−40° C. |
| 8 | H | <−40° C. |
| 9 | I | <−40° C. |
| 10 (comp.) | K | −21° C. |
| 11 (comp.) | L | +21° C. |
| 12 (comp.) | Tall oil fatty acid | −12° C. |
| 13 (comp.) | Oleic acid | +6° C. |

The pour point is determined as per ISO 3016.

Storage Stability of Additives.

The additives were stored at −25° C. for three days and then visually assessed. The absence of cloudiness and precipitates indicates the improved low temperature properties of the additives according to the invention.

TABLE 3

| Stability in storage | | |
|---|---|---|
| Example | Additive | Assessment after storage |
| 14 | A | Clear viscous fluid |
| 15 | B | Clear viscous fluid |
| 16 | C | Clear viscous fluid |
| 17 | D | Clear viscous fluid |
| 18 | E | Clear viscous fluid |
| 19 | F | Clear viscous fluid |
| 20 | G | Clear viscous fluid |
| 21 | H | Clear viscous fluid |
| 22 | I | Clear viscous fluid |
| 23 (comp.) | K | Crystalline, solid |
| 24 (comp.) | L | Waxy, solid |
| 25 (comp.) | Tall oil fatty acid | Crystalline, solid |
| 26 (comp.) | Oleic acid | Crystalline, solid |

Lubricity in Middle Distillates

The lubricating effect of the additives was determined on additized oils at 60° C. using an HFRR instrument from PCS Instruments. The High Frequency Reciprocating Rig (HFRR) Test is described in D. Wei, H. Spikes, Wear, Vol. 111, No. 2, p. 217, 1986. The results are reported as coefficient of friction and Wear Scar (WS 1.4). A low coefficient of friction and a low Wear Scar are evidence of a good lubricating effect.

The test oil used was a Scandinavian winter diesel having the following characteristics:

TABLE 4

| Properties of test oils | | |
|---|---|---|
| | Test oil 1 | Test oil 2 |
| Boiling range: | 198–355° C. | 182–312° C. |
| Density: | 0.832 g/cm$^3$ | 0.819 |
| Cloud Point: | −4° C. | −29° C. |
| Sulfur content: | 26 ppm | 2.7 ppm |

The boiling data were determined according to ASTM D-86 and the cloud point according to ISO 3015.

Table 5: Wear Scar in test oil 1

TABLE 5

| Wear Scar in test oil 1 | | | |
|---|---|---|---|
| | | 100 ppm in test oil 1 | |
| Example | Additive | WS 1.4 | Friction |
| 27 | without | 679 μm | 0.40 |
| 28 | 100 ppm A | 396 μm | 0.20 |
| 29 | 100 ppm B | 284 μm | 0.16 |
| 30 | 100 ppm C | 302 μm | 0.16 |
| 31 | 100 ppm D | 332 μm | 0.18 |
| 32 | 100 ppm E | 381 μm | 0.18 |
| 33 | 100 ppm F | 395 μm | 0.20 |
| 34 | 100 ppm G | 374 μm | 0.17 |
| 35 | 100 ppm H | 367 μm | 0.19 |
| 36 | 100 ppm I | 367 μm | 0.19 |
| 37 (comp.) | 100 ppm K | 346 μm | 0.18 |
| 38 (comp.) | 100 ppm L | 420 μm | 0.20 |
| 39 (comp.) | 100 ppm tall oil fatty acid | 433 μm | 0.21 |
| 40 (comp.) | 100 ppm oleic acid | 443 μm | 0.21 |

TABLE 6

| Wear Scar in test oil 2 | | | |
|---|---|---|---|
| | | 150 ppm in test oil 2 | |
| Example | Additive | WS 1.4 | Friction |
| 41 | without | 564 μm | 0.34 |
| 42 | B | 358 μm | 0.17 |
| 43 | D | 342 μm | 0.16 |
| 44 (comp.) | 100 ppm tall oil fatty acid | 394 μm | 0.19 |
| 45 (comp.) | 100 ppm oleic acid | 405 μm | 0.21 |

What is claimed is:

1. A fuel oil composition comprising a middle distillate having a sulfur content of up to 0.05% by weight and reaction products of A) mono- or dicarboxylate acids of 8 to 50 carbon atoms and B) primary, secondary or tertiary amines of the formula $NR^1R^2R^3$ where $R^1$ is a branched alkyl of 3 to 18 carbon atoms and $R^2$ and $R^3$ are independently hydrogen, $R^1$ or an alkyl of 1–12 carbon atoms, wherein said amines have at least one $C_3$–$C_8$ branched alkyl and wherein each of said branched alkyl has a secondary or a tertiary carbon atom or where the nitrogen atom is bonded to a secondary or tertiary carbon atom.

2. A fuel oil composition as claimed in claim 1, wherein A is a mono- or dicarboxylic acid of 12 to 22 carbon atoms.

3. A fuel oil composition as claimed in claim 1, wherein A comprises such carboxylic acids as contain one or more double bonds.

4. A fuel oil composition as claimed in claim 1, wherein $R^1$ is branched $C_4$–$C_{12}$-alkyl.

5. A fuel oil composition as claimed in claim 1, wherein $R^2$ and/or $R^3$ is or are branched $C_4$–$C_{12}$alkyl.

6. A fuel oil composition as claimed in claim 1, wherein $R^2$ and/or $R^3$ is or are hydrogen, methyl, ethyl, propyl or butyl.

7. A fuel oil composition as claimed in claim 1, wherein said amines are selected from the group consisting of isopropylamine, isobutylamine, 2-aminobutane, 3-methylbutylamine, 2-amylamine, 3-amylamine, tert-amylamine, 2-ethylhexylamine, isononylamine, di-sec-butylamine, di-2-amylamine, di-3-amylamine, di-tert-amylamine, di(2-ethylhexyl)amine, diisononylamine, and mixtures thereof.

8. A method for enhancing the lubricity of a middle distillate having a sulfur content of up to 0.05% by weight, said method comprising adding to said middle distillate an additive comprising a reaction product of A) mono- or dicarboxylic acids of 6 to 50 carbon atoms and B) primary, secondary or tertiary amines of the formula $NR^1R^2R^3$ where $R^1$ is branched alkyl of 3 to 18 carbon atoms and $R^2$ and $R^3$ are independently hydrogen, $R^1$ or alkyl of 1–12 carbon atoms, wherein said amines have at least one $C_3$–$C_8$ branched alkyl and wherein each of said branched alkyl has a secondary or a tertiary carbon atom or where the nitrogen atom is bonded to a secondary or tertiary carbon atom.

9. An additive for enhancing the lubricity of middle distillates having a sulfur content of up to 0.05% by weight, comprising reaction products of A) mono- or dicarboxylic acids of 6 to 50 carbon atoms and B) primary, secondary or tertiary amines of the formula $NR^1R^2R^3$ where $R^1$ is a branched alkyl of 3 to 18 carbon atoms and $R^2$ and $R^3$ are independently hydrogen, $R^1$ or alkyl of 1–12 carbon atoms, wherein said amines have at least one $C_3$–$C_8$ branched alkyl and wherein each of said branched alkyl has a secondary or a tertiary carbon atom or where the nitrogen atom is bonded to a secondary or tertiary carbon atom.

10. The method of claim 8 wherein the monocarboxylic acids have an iodine number of at least 40 gl/100 g.

11. The method of claim 8 wherein said dicarboxylic acids are selected from the group consisting of dimer fatty acids, alkylsuccinic acids, alkenylsuccinic acids, wherein said dicarboxylic acids have a $C_8$–$C_{50}$ alkyl radical.

12. The fuel oil composition of claim 1, wherein $R^1$ is selected from the group consisting of isopropyl, isobutyl, tert-butyl, 3-methylbutyl, amyl, 2-ethylhexyl, isomers of isononyl, and mixtures thereof.

13. The fuel oil composition of claim 1, wherein the amine is selected from the group consisting of 2-aminobutane, 2-aminopentane, 3-aminopentane, 2-aminohexane, 3-aminohexane, 2-aminoheptane, 2-amino-6-methylheptane and 2-amino-5-methylhexane, and mixtures thereof.

14. The fuel oil composition of claim 1, wherein A further comprises resin acids.

15. A fuel oil composition comprising a middle distillate having a sulfur content of up to 0.05% by weight and reaction products of A) a fatty acid selected from the group consisting of lauric acid, tridecanoic acid, myristic acid, pentadecanoic acid, palmitic acid, margaric acid, stearic acid, isostearic acid, arachidic acid, behenic acid, oleic acid, erucic acid, palmitoleic acid, myristoleic acid, linoleic acid, linolenic acid, elaeosteric acid, arachidonic acid, ricinoleic acid, coconut oil fatty acid, peanut oil fatty acid, fish oil fatty acid, linseed oil fatty acid, palm oil fatty acid, rapeseed oil fatty acid, ricinenic oil fatty acid, castor oil fatty acid, colza oil fatty acid, soybean oil fatty acid, sunflower oil fatty acid, tall oil fatty acid, and mixtures thereof, and B) an amine selected from the group consisting of di(2-ethylhexyl)amine, 2-aminobutane, 2-ethylhexylamine, di(sec-butylamine), isopropylamine, isobutylamine, 2-aminobutane, 3-methylbutylamine, 2-amylamine, 3-amylamine, tert-amylamine, 2-ethylhexylamine, isononylamine, di-sec-butylamine, di-2-amylamine, di-3-amylamine, di-tert-amylamine, diisononylamine and mixtures thereof.

16. The fuel oil composition of claim 15, wherein the middle distillate comprises reaction products of A) a tall oil fatty acid, and B) an amine selected from the group consisting of di(2-ethylhexyl)amine, 2-aminobutane, 2-ethylhexylamine, di(sec-butylamine), and mixtures thereof.

* * * * *